United States Patent [19]

Kato

[11] Patent Number: 4,781,645

[45] Date of Patent: Nov. 1, 1988

[54] INFLATABLE BAG WITH INNER AND INTERMEDIATE CONTAINERS AND GAS GENERATION SUBSTANCES WITHIN INNER CONTAINER

[75] Inventor: Kenichi Kato, Tokyo, Japan

[73] Assignee: Tadashi Sakuma, Tokyo, Japan

[21] Appl. No.: 866,346

[22] Filed: May 23, 1986

[30] Foreign Application Priority Data

May 24, 1985 [JP] Japan ..... 60-077135[U]
Aug. 12, 1985 [JP] Japan ..... 60-123785[U]

[51] Int. Cl.[4] ..... A63H 5/00; A63H 33/00

[52] U.S. Cl. ..... 446/188; 441/100; 446/221; 446/224; 446/226

[58] Field of Search ..... 272/8 R, 8 N, 27 R, 272/27 N; 446/184, 193, 220, 221, 222, 224, 226, 188; 441/98, 99, 100, 101; 124/67, 74

[56] References Cited

U.S. PATENT DOCUMENTS

| | | | |
|---|---|---|---|
| 686,412 | 11/1901 | Magnin | 441/101 |
| 1,217,277 | 2/1917 | Cohn | 446/224 |
| 1,518,897 | 12/1924 | Bruckner et al. | 446/193 |
| 2,097,542 | 11/1937 | Wallin | 441/100 |
| 2,635,387 | 4/1953 | Anderson | 446/221 |
| 3,472,218 | 10/1969 | Mers | 124/67 |
| 3,595,948 | 7/1971 | Cosani | 446/222 X |
| 4,213,267 | 7/1980 | Curtis | 446/221 |

FOREIGN PATENT DOCUMENTS

| | | | |
|---|---|---|---|
| 40-27321 | 9/1965 | Japan | 446/226 |
| 56-61275 | 5/1981 | Japan | 446/226 |
| 57-19184 | 4/1982 | Japan | 446/226 |
| 57-59188 | 12/1982 | Japan | 446/226 |

*Primary Examiner*—Richard T. Stouffer
*Attorney, Agent, or Firm*—Cushman, Darby & Cushman

[57] ABSTRACT

An inflatable bag comprises a small sack which is charged with sodium bicarbonate and accommodating a small externally breakable container filled with an acidic solution. The small sack is enveloped in an inflatable bag member which is made of a synthetic resin having no permeability to the gas which is generated as a reaction between the sodium bicarbonate and the acidic solution. As the small container is collapsed by external pressure, the acidic solution flows out of the container into reaction with the sodium bicarbonate, thereby generating carbon dioxide gas. The small sack is punctured by the gas pressure with a sound of a bang or a whistle and, thereafter, the inflatable gas member is gradually inflated.

15 Claims, 2 Drawing Sheets

INFLATABLE BAG WITH INNER AND INTERMEDIATE CONTAINERS AND GAS GENERATION SUBSTANCES WITHIN INNER CONTAINER

BACKGROUND OF THE INVENTION

Description of the Prior Art

The present invention relates to an inflatable bag. In known inflatable bags, a gas is generated through a reaction between sodium bicarbonate and an acidic solution, so as to automatically inflate the bag. Such inflatable bags are shown, for example, in Japanese Utility Model Application Nos. 77135/1985, 59188/1982, 61275/1981, 19184/1982 and 27321/1965.

In these known inflatable bags, the sodium bicarbonate charged in a sealed bag is scattered within the bag during, for example, transportation, so that the acidic solution released from a small container in the bag can hardly react with all parts of the sodium bicarbonate in the bag. In fact, the reaction between the acidic solution and the scattered sodium bicarbonate could not be attained unless the bag is shaken so as to bring the scattered sodium bicarbonate into reaction. This is difficult particularly when the bag has a large size and/or a complicated construction.

In addition, the known inflatable bag suffers from a disadvantage that the generated gas permeates through the wall of the bag in a short period of time, so that the bag deflates in a short time. When the gas is carbon dioxide gas which is soluble to water, the gas pressure is reduced very soon due to dissolution in the aqueous solution, so that the bag deflates in a very short time.

When the inflated bag is intended for use as an amusing instrument such as a ball, one can enjoy the play with this ball only for a while, due to rapid deflation of the ball. The same applies also to the case where the bag in the inflated state has the shape of a doll or an animal. Namely, in such a case, the bag can maintain the form of the doll or the animal only for a short time. For the same reason, a pillow or a cushion made of such an inflatable seat can withstand the use only for a short time.

Thus, the known inflatable bags of the kind are inconvenient and uneconomical.

SUMMARY OF THE INVENTION

Accordingly, an object of the invention is to provide an inflatable bag which is capable of overcoming the above-described problems of the prior art and which provides an amusement as a toy in that the process of the inflation can be observed visually.

According to an aspect of the invention, there is provided an inflatable bag which comprises an inflatable bag member, and a small sack confined in said bag member, said small sack containing sodium bicarbonate and a externally breakable container charged with an acidic solution. With this arrangement, the reaction between the sodium bicarbonate and the acidic solution is facilitated and completed because the sodium bicarbonate is not scattered but is confined in the small sack so that whole of the charged sodium bicarbonate can be brought into reaction. The externally breakable container can have the form of a bag or a capsule or a vessel such as a saucer sealed with a film. In order to prevent the solution from coming out unintentionally during storage or transportation, the container is preferably a cylindrical container with its upper opening sealed with a plastic or an aluminum foil.

A similar effect is obtainable by charging a small container with water and separately charging a powder of an acidic agent.

The acidic agent may be an organic acid or an inorganic acid. Examples of suitably used organic acid are tartaric acid and citric acid, while examples of the inorganic acid are hydrochloric acid and sulfuric acid. Considering that the inflatable bag of the invention is intended for use by ordinary purchasers or consumers, the acidic agent should be harmless one such as tartartic acid or citric acid.

Another feature of the invention resides in the use of a material having a high gas barrier effect as the material of the inflatable bag member.

Gases such as carbon dioxide ($CO_2$), oxygen ($O_2$) and nitrogen ($N_2$) are available comparatively easily. These gases have specific volumes of 0.506 /g ($CO_2$), 0.6998 /g ($O_2$) and 0.7995 /g ($N_2$), respectively, at temperature of 0° C. Under pressure of 1 ata. Thus, carbon dioxide has the greatest permeability to the bag material amongst the easily available gases. In the known bags proposed hitherto, carbon dioxide gas easily permeates through the bag material such as paper, cloth, vinylchloride and nylon, so that the bag is deflated easily.

In order to obviate this problem, therefore, the present invention proposes the use of a material having a high gas barrier effect, so as to prevent the carbon dioxide gas from permeating through the bag wall, thereby preventing deflation of the bag.

For instance, polyvinylidene chloride is usable as the bag material having high gas barrier effect.

The rapid deflation of the inflatable bag is partially attributable to dissolution of the carbon dioxide gas in the aqueous solution which is left after the reaction. The dissolution of the carbon dioxide gas can be avoided if the aqueous solution after the reaction is acidic. This can be achieved by adding the acidic solution by an amount which is at least 89% of the sodium bicarbonate in terms of weight.

The small sack containing sodium bicarbonate and the container charged with the acidic solution may be a paper sack or a vinyl chloride sack which exhibits small elongation. When the container is broken by an external force, the acidic solution flows out of the container into reaction with sodium bicarbonate. As a result, the small sack is inflated by the pressure of the $CO_2$ gas, so that it punctures with a sound "bang" after being inflated to its critical pressure with a sound "bang". The generation of th e$CO_2$ gas continues even after the puncture so that the bag continues to inflate after the puncture of the small sack because the generation of the carbon dioxide gas continues even after the puncture of the small sack. Thus, the "bang" is caused in the course of the continuous inflation of the bag. This inflatable bag, therefore, can be used as a frightening toy.

It is possible to use a plurality of small sacks made of a material which exhibits small extension, such that one small sack is contained in another sack. With this arrangement, the "bang" can be generated repeatedly by the same number as the number of the small sacks used. The puncture of the small sacks does not cause any danger because the solvent inside the bag does not come out.

The bag can contain a whistle connected to the small sack such that the whistle goes off by the gas pressure when the small sack is broken. When a plurality of small sacks are used together with whistles connected to these sacks, it is possible to blow these whistles successively. If these whistles are for different pitches of tone, the inflatable bag can play a short music.

Thus, the inflatable bag of the invention can amuse in the user both by generating sound and changing its size and appearance, as the bag gradually inflates.

DESCRIPTION OF THE PREFERRED EMBODIMENTS

Figure 1A:
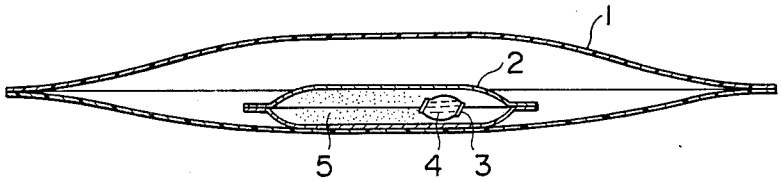
FIG. 1*a* is a sectional view of a first embodiment of the inflatable sack in accordance with the invention.

Referring first to FIG. 1a showing a first embodiment of the invention, a small sack 2 contains a mass of sodium bicarbonate 5 and an externally breakable small container 3 containing a solution 4 of tartaric acid. The small sack 2 in turn is encased in a bag member 1 made of vinlylidene chloride.

As the small container 3 is collapsed and broken by an external pressure applied by, for example, fingers, the tartaric acid solution 4 flows out from the small container 3 so as to react with the sodium bicarbonate 5, thereby generating carbon dioxide gas. Since the reaction takes place in a small sack 2, both reactants react with each other efficiently, so that the small sack 2 expands and then ruptures. The reaction further continues so that the bag member 1 of vinylidene chloride is inflated sufficiently. The vinylidene chloride is merely an example of the material which has both a barrier effect to the generated gas and a non-stretchability. Namely, the bag member 1 may be made of any other suitable material which has a high gas barrier effect. A large "bang"will be produced if the small sack 2 is made of a material having a small elongation.

Figure 1B:
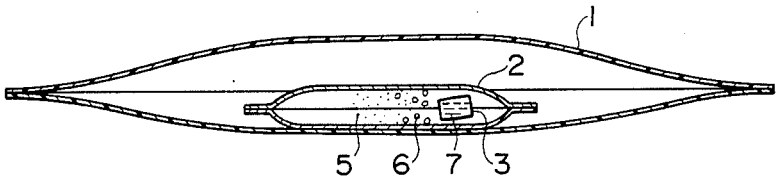
FIG. 1*b* is a sectional view of a modification of the embodiment shown in FIG. 1*a;*

FIG. 1*b* shows a modification in which the closed small sack 2 contains sodium bicarbonate 5, an acidic agent 6 and the small container 3 which in this case contains water. The small sack 2 in turn is enclosed in the bag member 1 which is made of vinylidene chloride.

Figure 2:
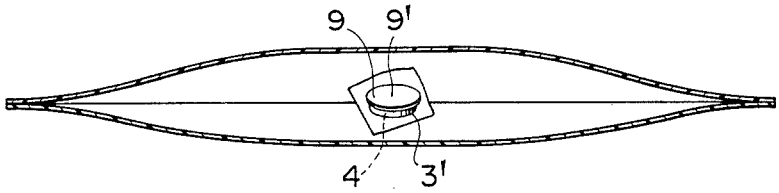
FIG. 2 is a sectional view of a second embodiment.

FIG. 2 shows a second embodiment in which the liquid container 3' is made of a thin-walled cylinder which is charged with the solution 4 and sealed with a vinyl resin film 9. The vinyl resin film 9 and the container 3' are rigid enough to withstand ordinary level of external pressure which is applied during ordinary transportation and storage. The vinyl resin film 9, however, can be broken easily as it is pressed by fingers, so that the solution 4 can flow out of the container 3.

Figure 3:
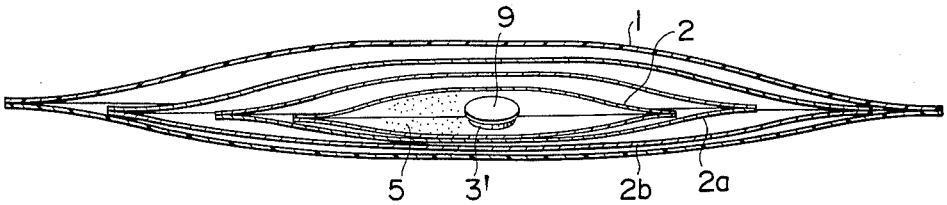
FIG. 3 is a sectional view of a third embodiment.

FIG. 3 shows a third embodiment which employs three small sacks 2, 2*a* and 2*b* which are arranged one in another. These small sacks 2, 2*a* and 2*b* are enclosed by the sack member 1 of vinylidene chloride. The innermost smallest sack 2 encases a small container 3' which is charged with a tartaric acid solution. As this small container is broken by an external pressure applied by, for example, fingers, the tartaric acid flows out of the container and reacts with the sodium bicarbonate charged in the sack 2, so that carbon dioxide gas is generated such as to inflate the sack 2 which is then punctured. The carbon dioxide gas then inflates the second small sack 2*a* which also is punctured after a while. The gas then inflates the third small sack 2*b*. Thus, "bang" is produced three times as three small sacks are punctured successively.

Figure 4:
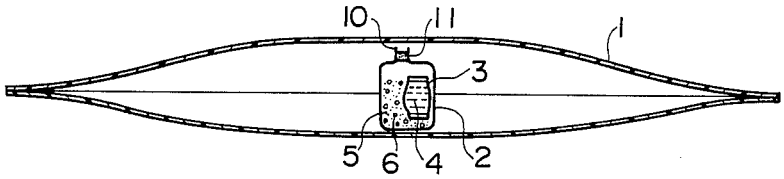
FIG. 4 is a sectional view of a fourth embodiment.
Figure 5:
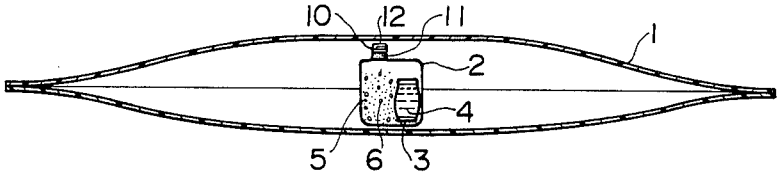
FIG. 5 is a sectional view of a modification of the fourth embodiment.

FIGS. 4 and 5 show a forth embodiment in which the small sack 2 is soft and encases sodium bicarbonate 5, acidic agent 6 and a small container 3' which can be broken by an external pressure, the small container 3' containing water. The small sack 2 has an opening 10 which is closed with a sponge 11 having continuous pores. This arrangement effectively prevents unintentional puncture of the small sack 2, and the reaction can be initiated only when it is required.

In the embodiment shown in FIG. 5, the small sack 2 is provided with a check valve 12 in the opening 10 thereof. The gas generated in the small sack 2, therefore, rushes into the inflatable bag member 1 so that the internal pressure is increased to inflate the bag member 1. On the other hand, the pressure in the small sack 2 is decreased as the reaction is finished, so that the check valve 12 of the small sack 2 is closed so as to isolate the gas and the aqueous solution from each other. Since the gas is kept away from the aqueous solution, the undesirable dissolution of the gas is prevented.

Figure 6:
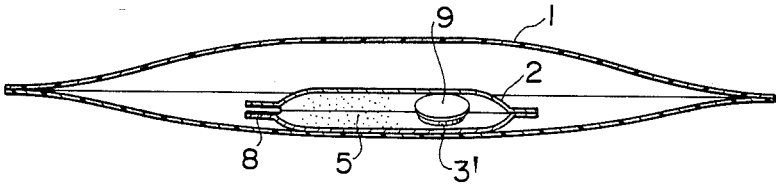
FIG. 6 is a sectional view of a fifth embodiment.

FIG. 6 shows an embodiment in which a whistle 8 is connected to the small sack 2, so that the gas blows the whistle to generate sound.

Figure 7:
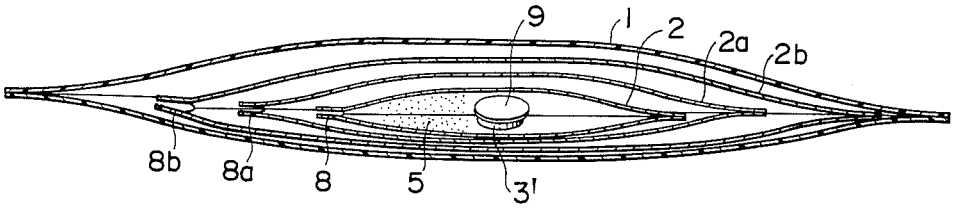
FIG. 7 is a sectional view of a modification of the embodiment shown in FIG. 6.

FIG. 7 shows a modification in which whistles 8, 8a and 8*b* are connected to flexible small sacks 2, 2*a* and 2*b*, so that the gas generated by the reaction is introduced into the second small sack through the whistle 8. The gas is then relieved into the space in the bag member 1 of vinylidene chloride through whistles 8*a* and 8*b*, thereby inflating the bag member 1. The whistles 8, 8*a* and 8*b* blow simultaneously to generate a harmony.

What is claimed is:

1. An inflatable bag, comprising:

a quantity of a first substance which when mixed with a quantity of a selected second substance will generate a quantity of inflating gas;

a quantity of a selected second substance which when mixed with said quantity of said first substance will generate said quantity of inflating gas;

an inner container being constituted by first wall means having an internal volume containing both said quantity of said first substance and said quantity of said selected second substance together with a breakable second wall means, which, while it remains unbroken, maintains said quantity of said first substance separated from said quantity of said selected second substance; and an outer container containing said inner container and being constituted by flexible third wall means defining a bag capable of having, when inflated, a substantially larger internal volume than said internal volume of said inner container;

said internal volume of said inner container being insufficient to contain all of said quantity of inflating gas and said first wall means of said inner container being constructed and arranged to permit said inflating gas to escape from said inner container into said internal volume of said outer container only after said breakable second wall means has been broken and said quantity of said first substance and said quantity of said selected second substance have substantially fully contacted one another within said inner container while said inner container has remained substantially intact but for breakage of said breakable second wall means;

said first and third wall means of said inner and outer containers being constructed and arranged to permit said breakable second wall means to be manually broken from externally of said outer container without rupturing said outer container and without rupturing said inner container and said first wall means of said inner container being relatively non-stretchable, so that as said quantity of inflating gas is generated in said inner container upon breakage of said breakable second wall means, at least some of said inflating gas, sufficient to inflate said internal volume of said outer container, must escape through said first wall means of said inner container into said internal volume of said outer container; and said internal volume of said outer container being sufficient to contain all of said quantity of inflating gas so as to dispose said outer container in an inflated condition;

one of said first substance and selected second substance being in powder form, and the other of said first substance and selected second substance being in liquid form;

said first substance being a mixture of sodium bicarbonate and an acidic agent and said second selected substance being water;

a first intermediate container being constituted by fourth wall means having an internal volume containing said inner container and being contained within said internal volume of said outer container;

said internal volume of said first intermediate container being insufficient to contain all of said inflating gas which escapes through said first wall means of said inner container upon contacting of said quantity of said first substance and said quantity of said selected second substance;

said fourth wall means of said first intermediate container being constructed and arranged to permit said inflating gas to escape from said first intermediate container into said internal volume of said outer container only after said inflating gas has escaped from said inner container into said first intermediate container and fully inflated said internal volume of said first intermediate container; and said fourth wall means of said first intermediate container being relatively non-stretchable, so that after said inflating gas begins to escape from said inner container into said first intermediate container so as to inflate said internal volume of said first intermediate container, at least some of said inflating gas must escape through said fourth wall means of said first intermediate container into said internal volume of said outer container; and said first and fourth wall means of said inner container and of said first intermediate container are constructed and arranged to successively suddenly rupture with an audible 'bang' for permitting escape of said inflating gas through the respective said first and fourth wall means.

2. The inflatable bag of claim 1, wherein:

said third wall means of said outer container is made of a synthetic resin which is substantially impermeable to carbon dioxide gas.

3. The inflatable bag of claim 2, wherein:

said synthetic resin is polyvinylidine chloride.

4. The inflatable bag of claim 1, wherein:

said third wall means of said outer container is made of a synthetic resin which is substantially impermeable to carbon dioxide gas.

5. The inflatable bag of claim 4, wherein:

said synethetic resin is polyvinylidine chloride.

6. An inflatable bag, comprising:

a quantity of a first substance which when mixed with a quantity of a selected second substance will generate a quantity of inflating gas;

a quantity of a selected second substance which when mixed with said quantity of said first substance will generate said quantity of inflating gas;

an inner container being constituted by first wall means having an internal volume containing both said quantity of said first substance and said quantity of said selected second substance together with a breakable second wall means, which, while it remains unbroken, maintains said quantity of said first substance separated from said quantity of said selected second substance; and an outer container containing said inner container and being constituted by flexible third wall means defining a bag capable of having, when inflated, a substantially larger internal volume than said internal volume of said inner container;

said internal volume of said inner container being insufficient to contain all of said quantity of inflating gas and said first wall means of said inner container being constructed and arranged to permit said inflating gas to escape from said inner container into said internal volume of said outer container only after said breakable second wall means has been broken and said quantity of said first substance and said quantity of said selected second substance have substantially fully contacted one another within said inner container while said inner container has remained substantially intact but for breakage of said breakable second wall means;

said first and third wall means of said inner and outer containers being constructed and arranged to permit said breakable second wall means to be manually broken from externally of said outer container without rupturing said outer container and without rupturing said inner container and said first wall means of said inner container being relatively non-stretchable, so that as said quantity of inflating gas is generated in said inner container upon breakage of said breakable second wall means, at least some of said inflating gas, sufficient to inflate said internal volume of said outer container, must escape through said first wall means of said inner container into said internal volume of said outer container; and said internal volume of said outer container being sufficient to contain all of said quantity of inflating gas so as to dispose said outer container in an inflated condition;

one of said first substance and selected second substance being in powder form, and the other of said first substance and selected second substance being in liquid form;

said first substance being sodium bicarbonate and said second selected substance being an acidic solution;

a first intermediate container being constituted by fourth wall means having an internal volume containing said inner container and being contained within said internal volume of said outer container;

said internal volume of said first intermediate container being insufficient to contain all of said inflating gas which escapes through said first wall means of said inner container upon contacting of said quantity of said first substance and said quantity of said selected second substance;

said fourth wall means of said first intermediate container being constructed and arranged to permit said inflating gas to escape from said first intermediate container into said internal volume of said outer container only after said inflating gas has escaped from said inner container into said first intermediate container and fully inflated said internal volume of said first intermediate container; and said fourth wall means of said first intermediate container being relatively non-stretchable, so that after said inflating gas begins to escape from said inner container into said first intermediate container so as to inflate said internal volume of said first intermediate container, at least some of said inflating gas must escape through said fourth wall means of said first intermediate container into said internal volume of said outer container; and said first and fourth wall means of said inner container and of said first intermediate container are constructed and arranged to successively suddenly rupture with an audible 'bang' for permitting escape of said inflating gas through the respective said first and fourth wall means.

7. The inflatable bag of claim 6, wherein:

said third wall means of said outer container is made of a synthetic resin which is substantially impermeable to carbon dioxide gas.

8. The inflatable bag of claim 7, wherein:

said synthetic resin is polyvinylidine chloride.

9. The inflatable bag of claim 6, wherein:

said third wall means of said outer container is made of a synthetic resin which is substantially impermeable to carbon dioxide gas.

10. The inflatable bag of claim 9, wherein:

said synthetic resin is polyvinylidine chloride.

11. An inflatable bag, comprising:

a quantity of a first substance which when mixed with a quantity of a selected second substance will generate a quantity of inflating gas;

a quantity of a selected second substance which when mixed with said quantity of said first substance will generate said quantity of inflating gas;

an inner container being constituted by first wall means having an internal volume containing both said quantity of said first substance and said quantity of said selected second substance together with a breakable second wall means, which, while it remains unbroken, maintains said quantity of said first substance separated from said quantity of said selected second substance; and an outer container containing said inner container and being constituted by flexible third wall means defining a bag capable of having, when inflated, a substantially larger internal volume than said internal volume of said inner container;

said internal volume of said inner container being insufficient to contain all of said quantity of inflating gas and said first wall means of said inner container being constructed and arranged to permit said inflating gas to escape from said inner container into said internal volume of said outer container only after said breakable second wall means has been broken and said quantity of said first substance and said quantity of said selected second substance have substantially fully contacted one another within said inner container while said inner container has remained substantially intact but for breakage of said breakable second wall means;

said first and third wall means of said inner and outer containers being constructed and arranged to permit said breakable second wall means to be manually broken from externally of said outer container without rupturing said outer container and without rupturing said inner container and said first wall means of said inner container being relatively non-stretchable, so that as said quantity of inflating gas is generated in said inner container upon breakage of said breakable second wall means, at least some of said inflating gas, sufficient to inflate said internal volume of said outer container, must escape through said first wall means of said inner container into said internal volume of said outer container; and said internal volume of said outer container being sufficient to contain all of said quantity of inflating gas so as to dispose said outer container in an inflated condition;

a first intermediate container being constituted by fourth wall means having an internal volume containing said inner container and being contained within said internal volume of said outer container;

said internal volume of said first intermediate container being insufficient to contain all of said inflating gas which escapes through said first wall means of said inner container upon contacting of said quantity of said first substance and said quantity of said selected second substance;

said fourth wall means of said first intermediate container being constructed and arranged to permit said inflating gas to escape from said first intermediate container into said internal volume of said outer container only after said inflating gas has escaped from said inner container into said first intermediate container and fully inflated said internal volume of said first intermediate container; and said fourth wall means of said first intermediate container being relatively non-stretchable, so that after said inflating gas begins to escape from said inner container into said first intermediate container so as to inflate said internal volume of said first intermediate container, at least some of said inflating gas must escape through said fourth wall means of said first intermediate container into said internal volume of said outer container.

12. The inflatable bag of claim 1, wherein:

each of said first and fourth wall means of said inner container and said first intermediate container is provided with whistle means constructed and arranged to audibly emit a whistling sound as inflating gas escapes therethrough respectively from said inner container into said first intermediate container and from said first intermediate container into said outer container.

13. The inflatable bag of claim 11, wherein:

one of said first substance and selected second substance is in powder form, and the other of said first substance and selected second substance is in liquid form.

14. The inflatable bag of claim 13, wherein:

said first and fourth wall means of said inner container and of said first intermediate container are constructed and arranged to successively suddently rupture with an audible 'bang' for permitting escape of said inflating gas through the respective said first and fourth wall means.

15. The inflatable bag of claim 11, wherein:

said first and fourth wall means of said inner container and of said first intermediate container are constructed and arranged to successively suddently rupture with an audible 'bang' for permitting escape of said inflating gas through the respective said first and fourth wall means

* * * * *